US007468011B2

(12) United States Patent
Tsuchida

(10) Patent No.: US 7,468,011 B2
(45) Date of Patent: Dec. 23, 2008

(54) WORK TABLE APPARATUS FOR A STRINGING MACHINE FOR TENNIS RACKETS

(76) Inventor: Akira Tsuchida, 4-3, Honcho 2-Chome, Higaski-Kurume, Tokyo (JP)

( * ) Notice: Subject to any disclaimer, the term of this patent is extended or adjusted under 35 U.S.C. 154(b) by 0 days.

(21) Appl. No.: 12/011,079

(22) Filed: Jan. 23, 2008

(65) Prior Publication Data

US 2008/0214337 A1 Sep. 4, 2008

(30) Foreign Application Priority Data

Jan. 23, 2007 (JP) ..... 2007-012136

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS

| | | | | |
|---|---|---|---|---|
| 3,117,783 | A * | 1/1964 | Reid | 473/470 |
| 3,874,664 | A * | 4/1975 | Faurot et al. | 473/462 |
| 4,119,838 | A * | 10/1978 | Genuit | 377/5 |
| 4,417,729 | A * | 11/1983 | Morrone | 473/556 |
| 4,491,954 | A * | 1/1985 | Genuit | 377/5 |
| 5,568,921 | A * | 10/1996 | Lorentzen et al. | 473/556 |
| 5,733,210 | A * | 3/1998 | Yiu | 473/475 |
| 5,820,500 | A * | 10/1998 | Raos | 473/557 |
| 6,227,990 | B1 * | 5/2001 | Wise et al. | 473/557 |
| 7,252,606 | B1 * | 8/2007 | Lee | 473/557 |
| 2008/0214337 | A1 * | 9/2008 | Tsuchida | 473/555 |

FOREIGN PATENT DOCUMENTS

EP 136245 A2 * 4/1985

* cited by examiner

*Primary Examiner*—Raleigh W. Chiu
(74) *Attorney, Agent, or Firm*—Craig M. Stainbrook; Stainbrook & Stainbrook, LLP

(57) ABSTRACT

A work table tilting apparatus for a stringing machine for tennis rackets which allows free tilt at any angle toward the front of the user.

1 Claim, 12 Drawing Sheets

WORK TABLE APPARATUS FOR A STRINGING MACHINE FOR TENNIS RACKETS

CROSS REFERENCES TO RELATED APPLICATIONS

The present application claims the benefit, under 35 U.S.C. §119(e), of Japan Patent Application Ser. No. 2007-12136, filed Jan. 23, 2007 in the Japan Patent Office.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates to a work table tilting apparatus for a stringing machine for tennis rackets, and more specifically, a work table tilting apparatus capable of freely tilting the work table at any angle toward the front of the user by being installed between the stand and the work table.

1. Discussion of Related Art Including Information Disclosed Under 37 CFR §§1.97, 1.98

A stringing machine for rackets of tennis, badminton, squash, racquetball, etc., has a configuration as shown in FIGS. 13 and 14. Namely, a stringing machine 100 comprises a turntable 103 that supports fixing bases 101, 101 and string clamping mechanisms 102, 102; a tension unit 104 for applying tension to the string at a specific pressure; a work table 105 for setting the turntable 103 and the tension unit 104 on the top thereof; and a stand 106 that supports the work table 105.

However, in such a conventional stringing machine 100 for rackets, there is a problem in that users must always lean forward while stringing the racket because the work table 105, i.e. the work surface, is always horizontal, thereby creating a difficulty in stringing the racket and easily causing fatigue in users. Moreover, wheelchair tennis has become very popular among physically impaired individuals these days, but a player in a wheelchair cannot string his/her racket easily because his/her body and the work surface are apart from each other and the work surface is located too high.

The present invention is devised taking into account the above problems and provides a work table tilting apparatus capable of freely tilting the work table at any angle toward the front of the user by being installed between the stand and the work table, thereby improving the working efficiency by straightening the working posture in addition to reducing the degree of fatigue, and furthermore, capable of lowering the working surface due to its large tilting angle and adjustment of the stand to a lower position so that a player in a wheelchair can easily string his/her racket.

The present invention is directed at a work table tilting apparatus for a stringing machine for tennis rackets comprising: a fixing bracket that is fixed to the top of a stand, wherein downward vertical plates are integrally formed on both the right and left sides of a horizontal pate, and threaded holes are provided at the same level at the front end and rear end of said right and left vertical plates; and a movable bracket fixed to the center of the bottom of the work table and that covers said fixing bracket, wherein downward vertical plates are integrally formed on both the right and left sides of a horizontal plate, and insertion holes for lock screws are provided at the front end of said vertical plates, and elongated arcuate insertion holes for lock screws, the top of which is located at the same level as said insertion holes for the lock screws, are provided at the rear end of said vertical plates, and wherein said fixing bracket and movable bracket are connected by screwing the lock screws, which are inserted through the insertion holes for the lock screws of the movable bracket, to the threaded holes of the fixing bracket.

With the configuration as described above, the present invention is capable of freely tilting the work table at any angle toward the front of the user by being installed between the stand and the work table. Whereby, the invention improves the working efficiency by straightening the working posture and reduces the degree of fatigue, and furthermore, is capable of lowering the working surface due to its large tilting angle and adjustment of the stand to a lower position so that a player in a wheelchair can easily string his/her racket.

BRIEF SUMMARY OF THE INVENTION

It is therefore an object of the present invention to provide a new and improved The best mode for carrying out the invention comprises: a fixing bracket that is fixed to the top of a stand, wherein downward vertical plates are integrally formed on both the right and left sides of a horizontal pate, and threaded holes are provided at the same level at the front and rear ends of said right and left vertical plates; and a movable bracket that is fixed to the center of the bottom of the work table and that covers said fixing bracket, wherein downward vertical plates are integrally formed on both the right and left sides of a horizontal plate, and insertion holes for lock screws are provided at the front end of said vertical plates, and elongated arcuate insertion holes for lock screws, the top of which is located at the same level as said insertion holes for the lock screws, are provided at the rear end of said vertical plates, and wherein said fixing bracket and movable bracket are connected by screwing the lock screws, which are inserted through the insertion holes for the lock screws of the movable bracket, to the threaded holes of the fixing bracket.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DRAWING REFERENCE NUMERALS

FIGS. 1-14

Figure 1:
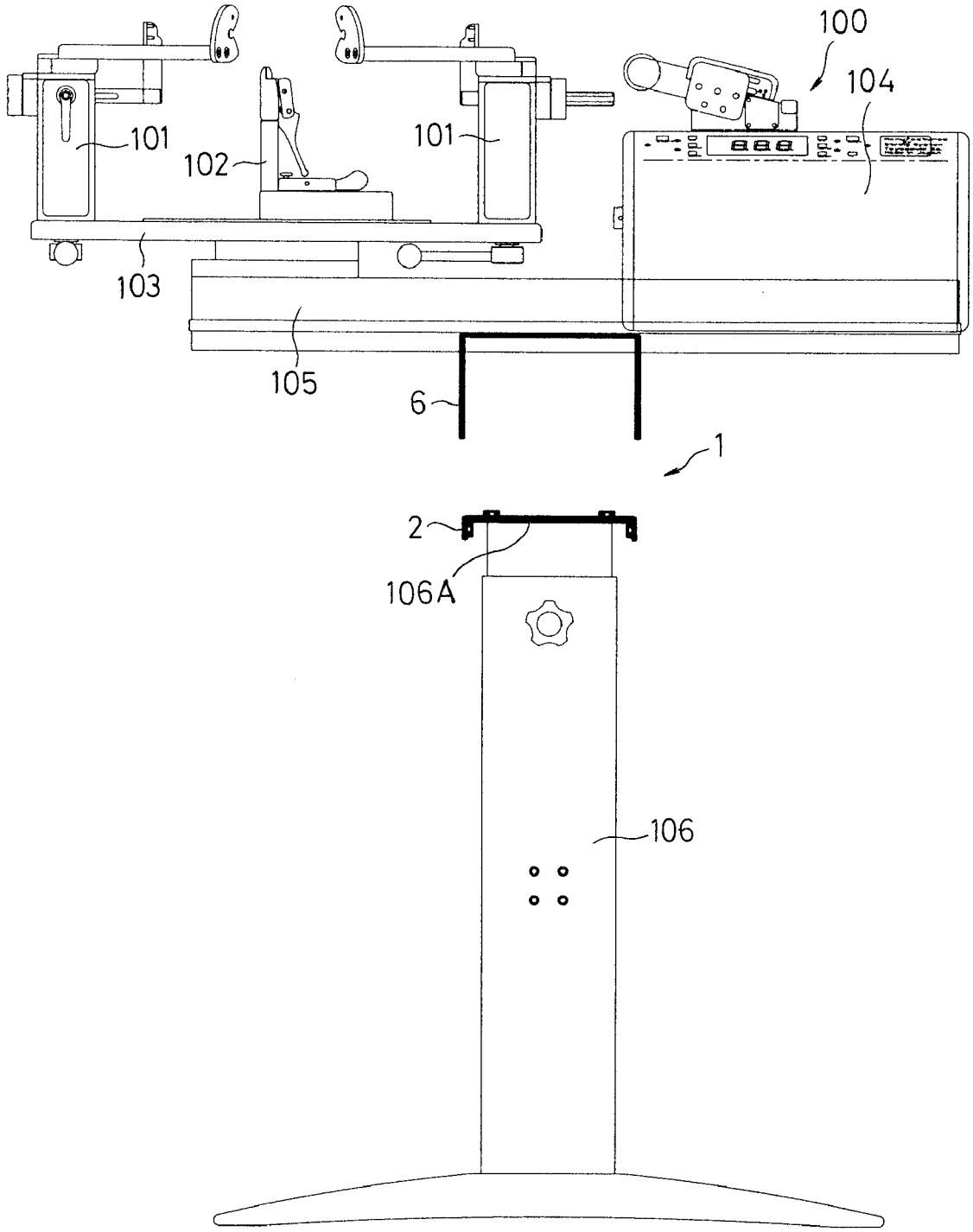
FIG. 1 is an elevational view of a broken-down stringing machine for tennis rackets in accordance with the invention.

1 Work table tilting apparatus
2 Fixing bracket
2*a* Horizontal plate
2*b* Right and left vertical plates
2*b*' Penetrating holes
3 Threaded holes
3' Attaching nuts
4 Lock screws
5 Threaded holes
6 Movable bracket
6*a* Horizontal plate
6*b* Right and left vertical plates
7 Insertion holes for lock screws
8 Elongated arcuate insertion holes
9 Lock screws
100 Stringing machine
101 Fixing base
102 String clamping mechanism
103 Turntable
104 Tension unit
105 Work table
106 Stand

DETAILED DESCRIPTION OF THE INVENTION

Referring to FIGS. 1 through 14, wherein like reference numerals refer to like components in the various views, there is illustrated therein a new and improved work table tilting apparatus for a stringing machine for tennis rackets, generally denominated 100 herein.

Figure 2:
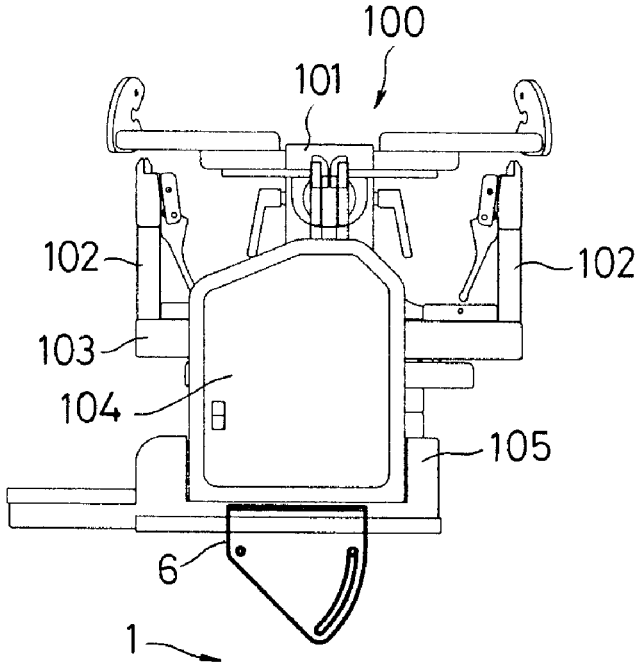
FIG. 2 is a right side view of the broken-down stringing machine for tennis rackets in accordance with the invention.
Figure 2:
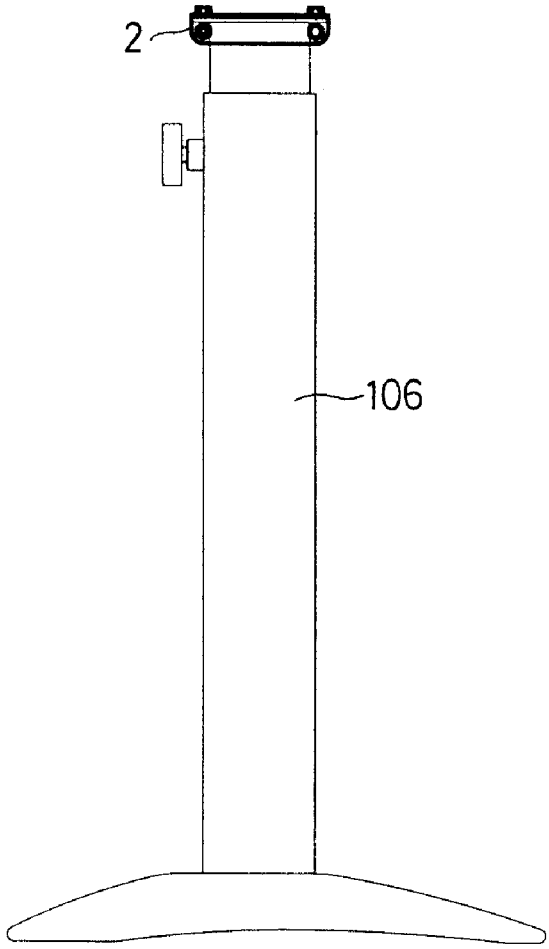
Figure 3:
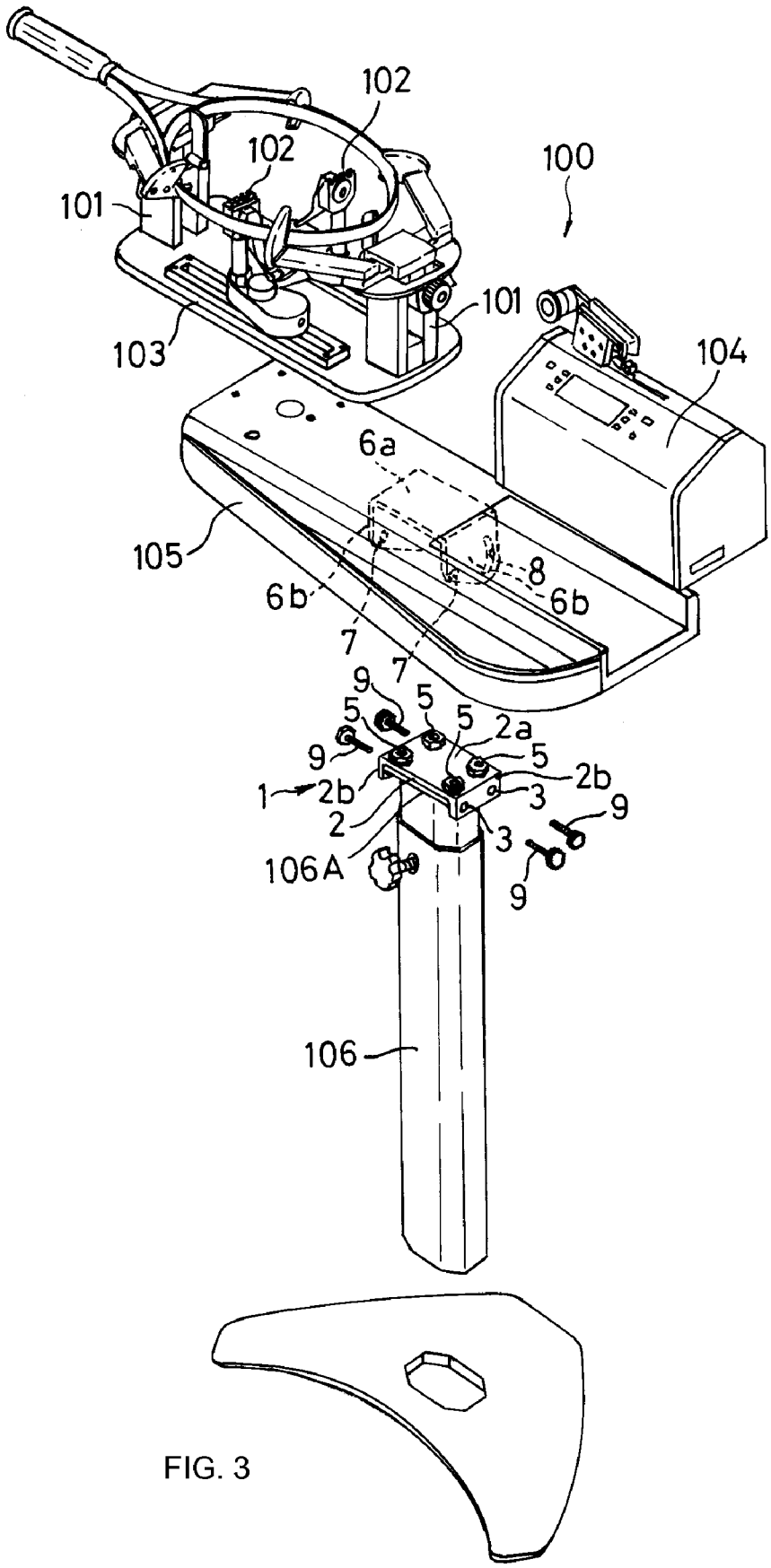
FIG. 3 is a perspective view of the broken-down stringing machine for tennis rackets in accordance with the invention.
Figure 4:
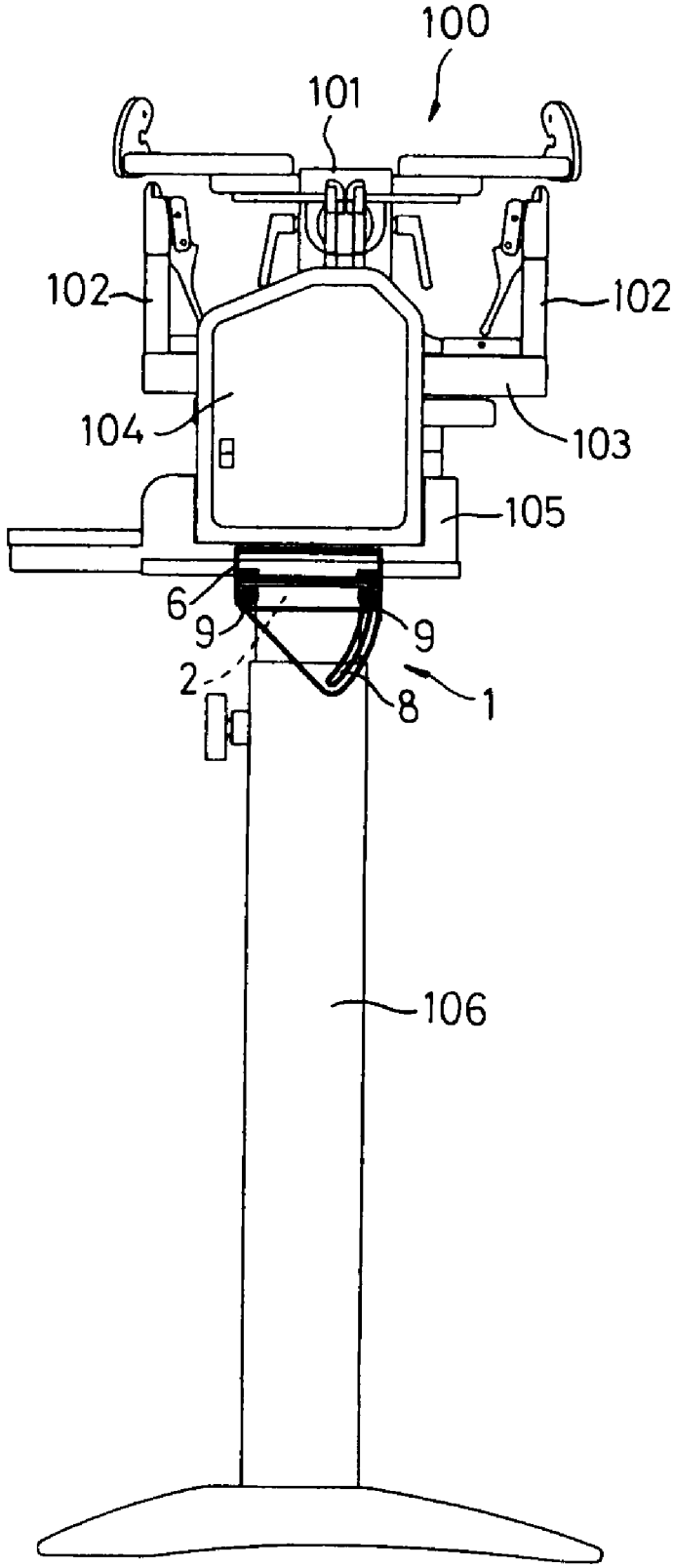
FIG. 4 is a right side view of an assembled stringing machine for tennis rackets in accordance with the invention.
Figure 5:
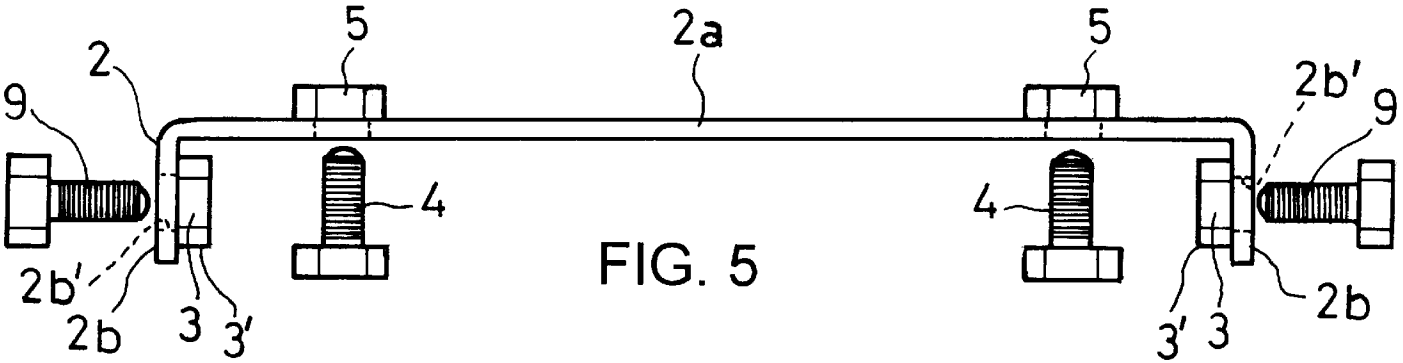
FIG. 5 is an elevational view of a fixing bracket.
Figure 6:
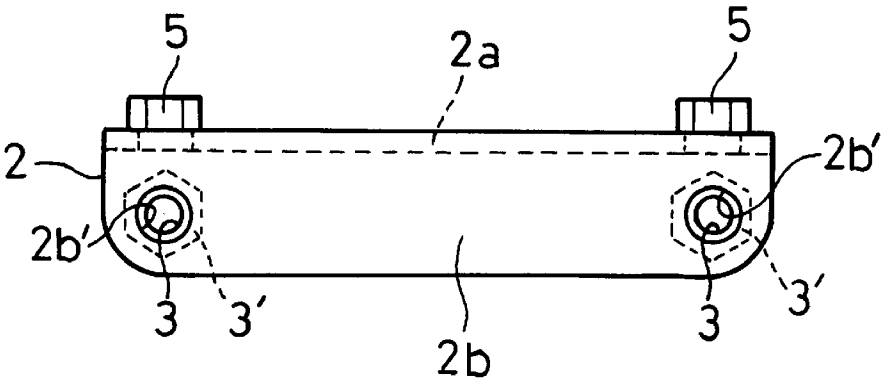
FIG. 6 is a right side view of the fixing bracket.
Figure 7:
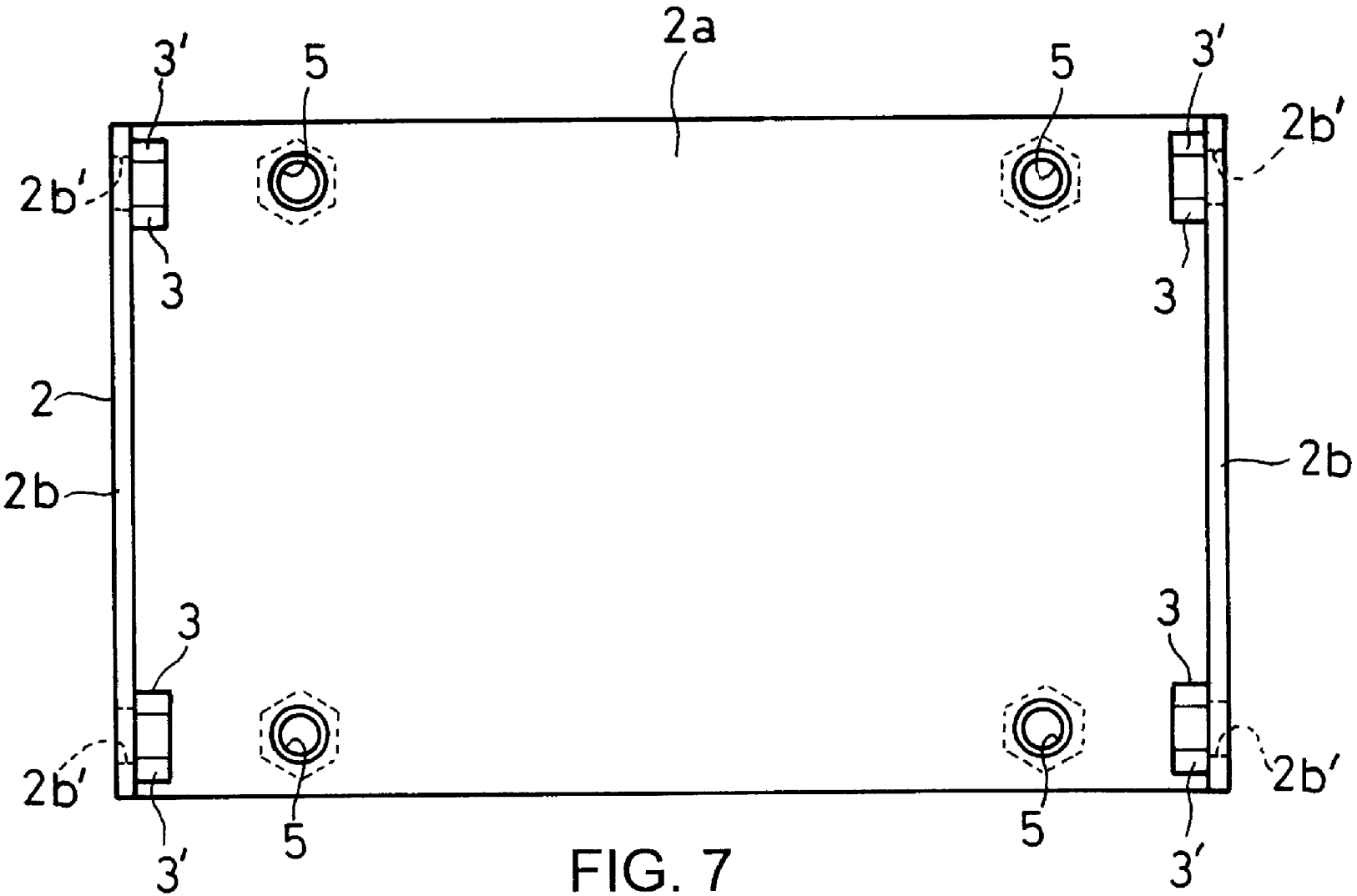
FIG. 7 is a bottom view of the fixing bracket.
Figure 8:
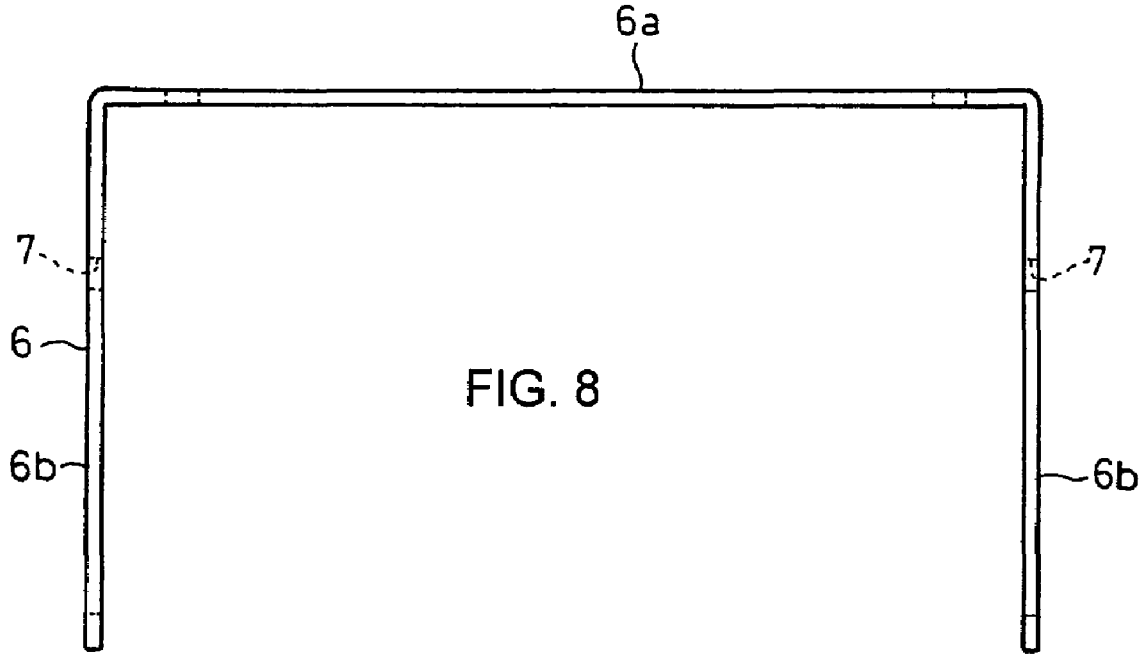
FIG. 8 is an elevational view of a movable bracket.
Figure 9:
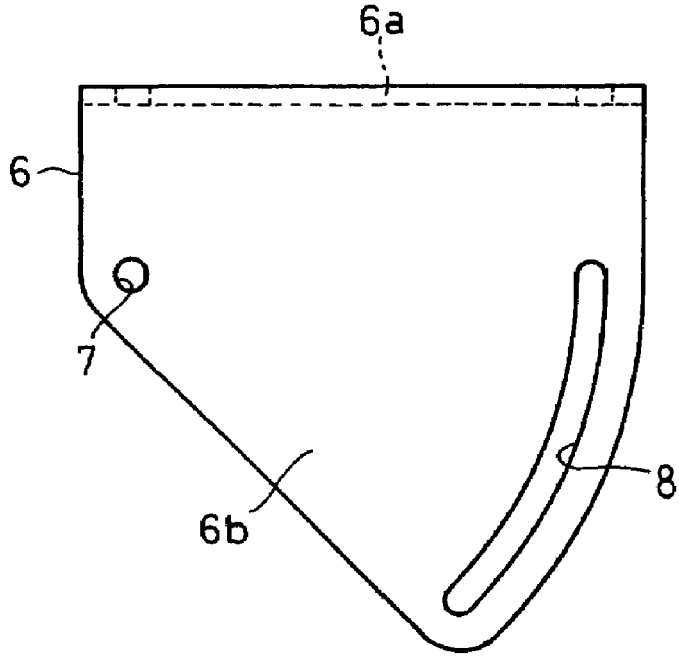
FIG. 9 is a right side view of the movable bracket.
Figure 10:
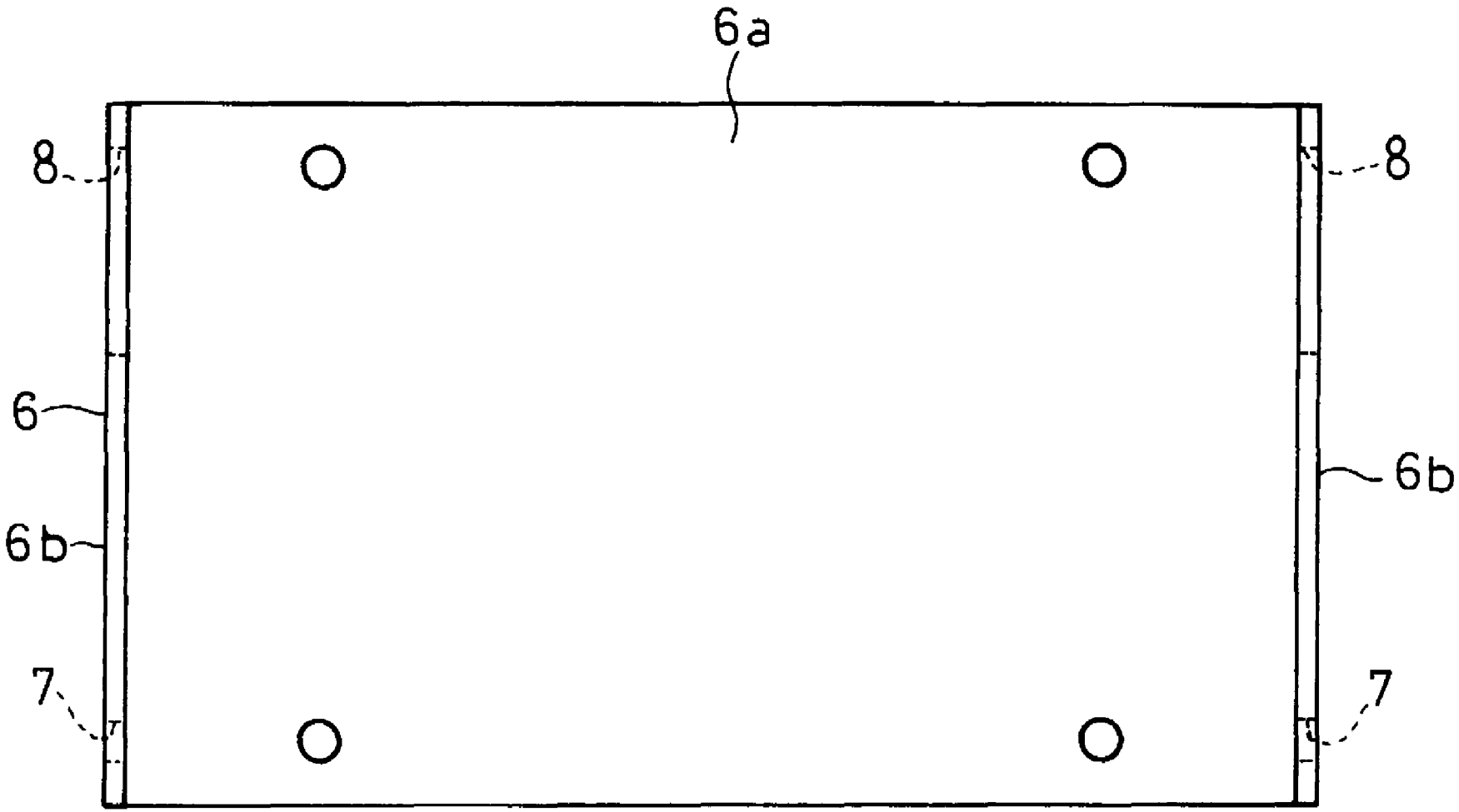
FIG. 10 is a bottom view of the movable bracket.
Figure 11:
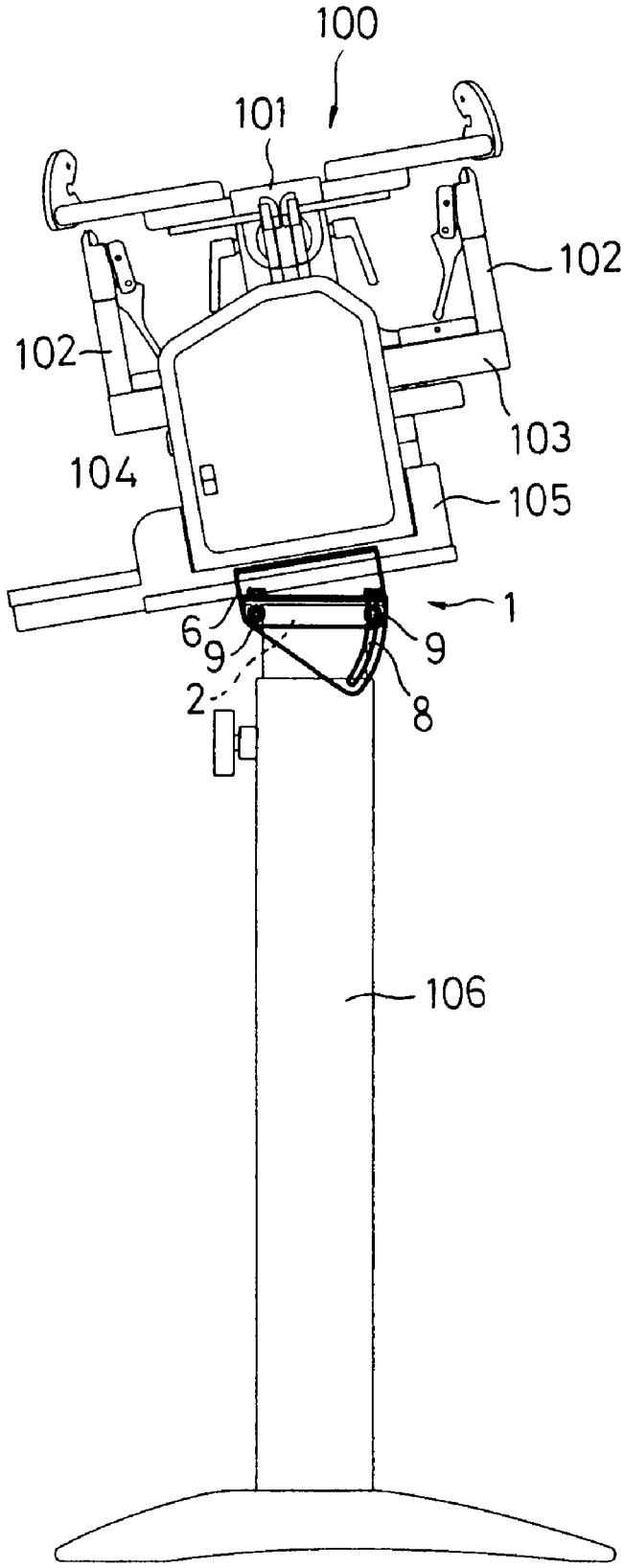
FIG. 11 is an explanatory drawing of the invention, showing a tilted work table.
Figure 12:
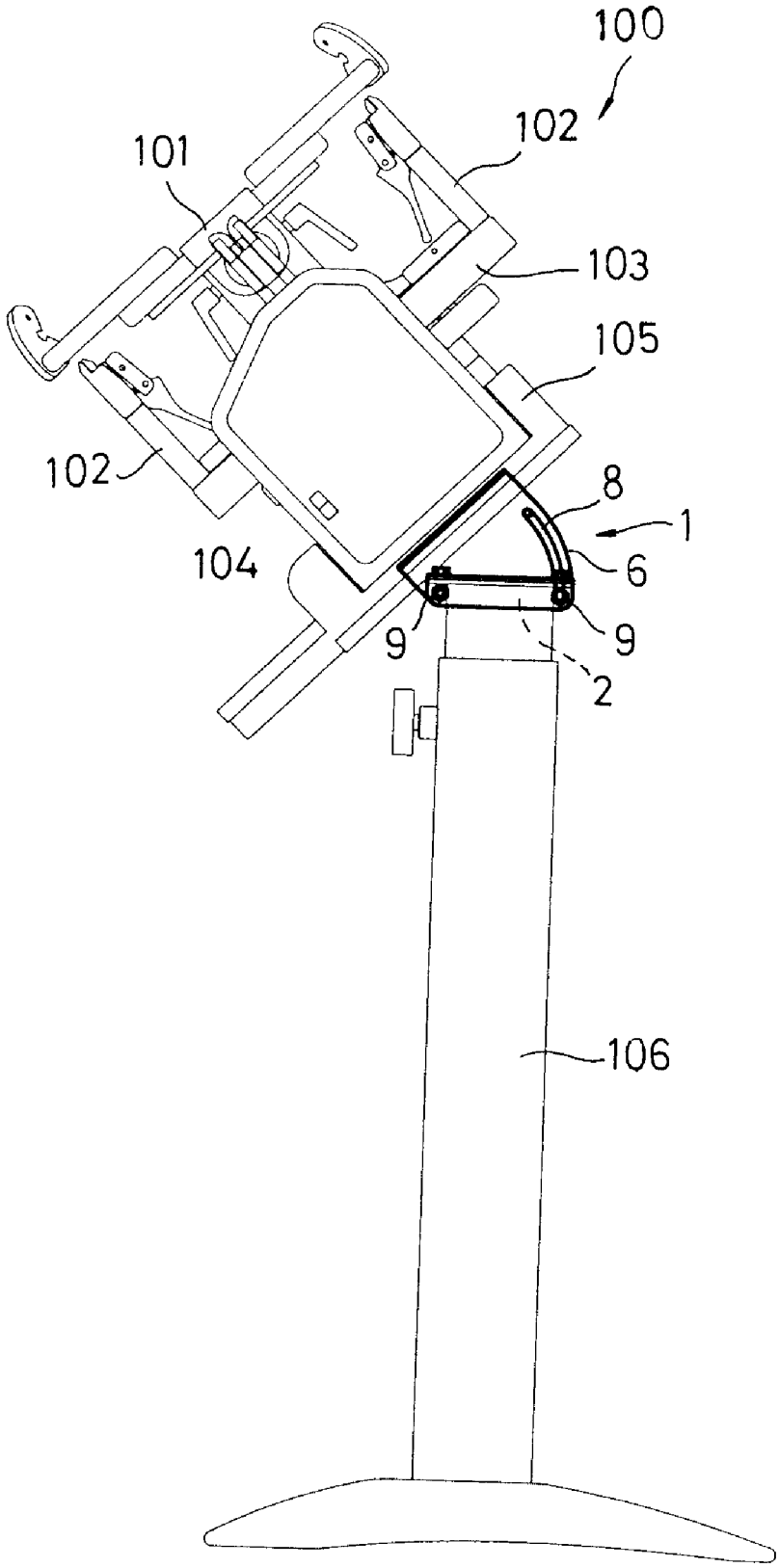
FIG. 12 is an explanatory drawing of the invention, showing a work table tilted at the maximum angle.

Embodiments of the invention will be described below. FIG. 1 is an elevational view of a broken-down stringing machine for tennis rackets in accordance with the invention; FIG. 2 is a right side view of the same; FIG. 3 is a perspective view of the same; FIG. 4 is a right side view of an assembled stringing machine for tennis rackets in accordance with the invention; FIG. 5 is an elevational view of a fixing bracket; FIG. 6 is a right side view of the same; FIG. 7 is a bottom view of the same; FIG. 8 is an elevational view of a movable bracket; FIG. 9 is a right side view of the same; FIG. 10 is a bottom view of the same; and FIGS. 11 and 12 are explanatory drawings for the invention.

Figure 13:
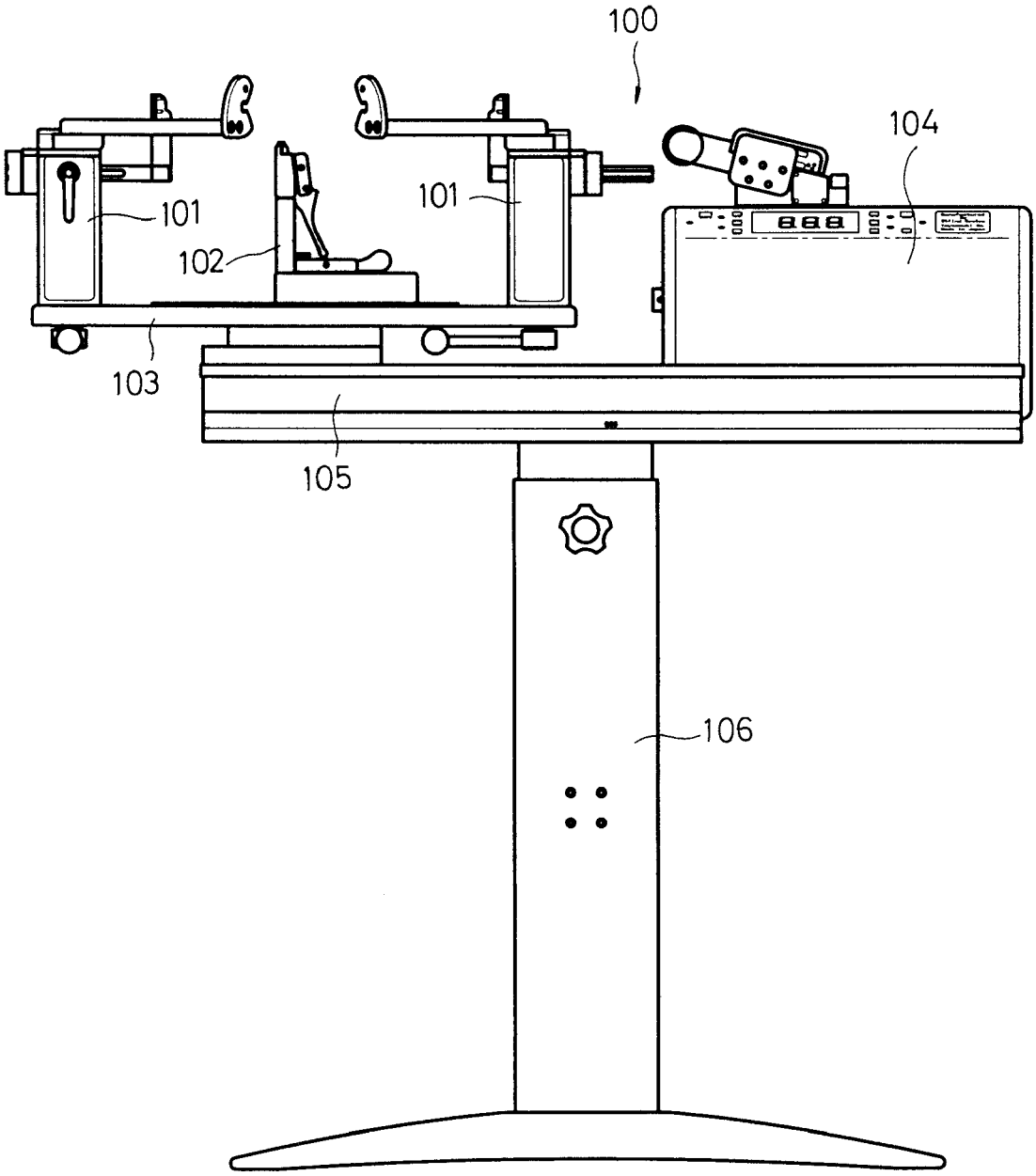
FIG. 13 is an elevational view of the conventional stringing machine for tennis rackets.
Figure 14:
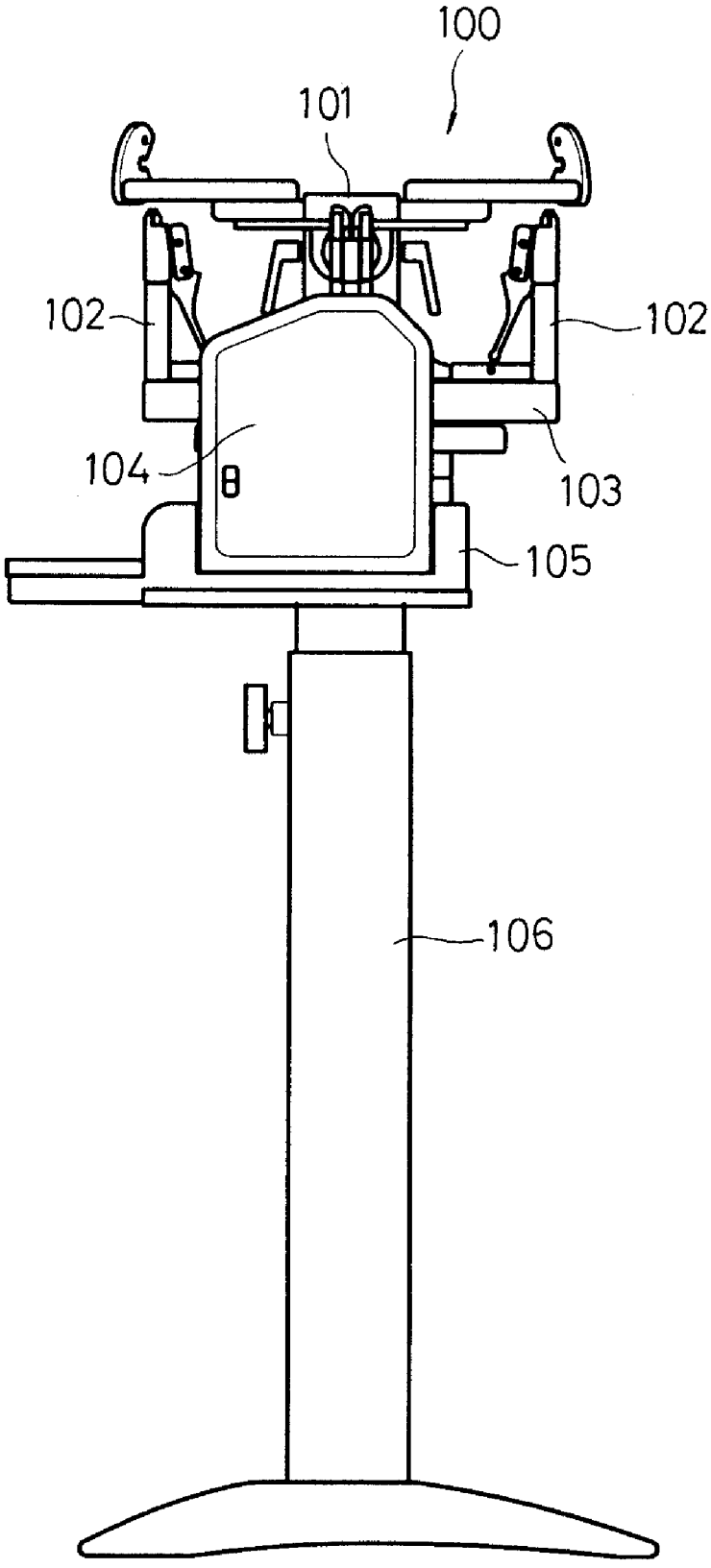
FIG. 14 is a right side view of the conventional stringing machine for tennis rackets.

The stringing machine for tennis rackets is the same in itself as the conventional machine as shown in FIGS. 13 and 14, so the same symbols are used for the same members and further explanation is omitted.

In the figures, reference number 1 refers to a work table tilting apparatus that is capable of freely tilting the work table 105 at any angle toward the front of the user by being installed between the stand 106 and the work table 105. Moreover, the work table tilting apparatus 1 comprises a fixing bracket and a movable bracket described below.

Reference number 2 is a fixing bracket fixed to the top of a stand 106. Moreover, in the fixing bracket 2, downward vertical plates 2*b* are integrally formed on both the right and left side of a horizontal plate 2*a*, and threaded holes 3 are provided at the same level at the front and rear ends of the right and left vertical plates 2*b*.

In addition, in this embodiment, the threaded holes 3 are made by providing penetrating holes 2*b*' on the right and left vertical plates 2*b* and attaching nuts 3' on the inside of the plates at a position corresponding to the penetrating holes 2*b*'; however, the threaded holes 3 may be made by directly drilling a threaded hole in the right and left vertical plates 2*b*.

Furthermore, in this embodiment, screw locking is employed as a means of fixation to the top of the stand 106, but alternatively, adhesion, welding, etc., may be employed.

In this embodiment, the screw locking is achieved by screwing lock screws 4, which are inserted through penetrating holes (not shown) provided at the four corners of a horizontal plate 106A on the top of the stand 106, to threaded holes 5 provided at the four corners of a horizontal plate 2*a* of the fixing bracket 2. Also, these threaded holes 5 are formed in the same manner as the above.

Reference number 6 is a movable bracket that is fixed to the center of the bottom of the work table 105, and is connected to the fixing bracket 2 using lock screws described below while covering the fixing bracket 2.

Moreover, in the movable bracket 6, downward vertical plates 6*b*, are integrally formed on both the right and left sides of a horizontal plate 6*a*, and insertion holes 7, for lock screws are provided at the front end of said vertical plates, and elongated arcuate insertion holes 8, for lock screws, the top of which is located at the same level as said insertion holes 7, for the lock screws, are provided at the rear end of said vertical plates. In this embodiment, the vertical plates 6*b*, are of a triangular shape, and the respective elongated arcuate insertion holes 8, for lock screws are provided along a circle having the respective insertion holes 7, for lock screws as a center.

Also, an appropriate means selected from screw locking, adhesion, welding, etc., is used as a means for fixing the movable bracket 6 to the center of the bottom of the work table 105.

Reference numbers 9 are lock screws that are used for connecting the fixing bracket 2 and the movable bracket 6 as well as fixing the movable bracket 6 at a position tilted at the desired angle. Moreover, the lock screws 9 are inserted through the insertion hole 7 for lock screws and the elongated arcuate insertion holes 8, for lock screws provided on the vertical plate 6*b*, of the movable bracket 6, and screwed into the threaded holes 3, provided on the vertical plate 2*b* of the fixing bracket 2.

Next, the operation of the above embodiment will be described.

FIG. 4 shows the work table 105 in a horizontal position. Now, in order to tilt the table toward the front of the user from this position, loosen all the lock screws 9, first, and then turn the movable bracket 6 vertically about the lock screws 9, at the front end as a pivoting point. Then, when the work table 105 is tilted at a desired angle, firmly tighten all the lock screws 9 again. When these lock screws 9 are firmly tightened, the bottom surface of the head of the lock screws 9 is firmly pressed to the outer surface of the vertical plates 6*b* of the movable bracket 6, thereby applying braking force. As a result, as shown in FIG. 11, the work table 105 is secured at a position tilted at a desired angle toward the front of the user. In addition, in order to further tilt the work table 105 as shown in FIG. 12, the same procedure as above is taken.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A work table tilting apparatus for a stringing machine for tennis rackets comprising:

a fixing bracket fixed to the top of a stand, wherein downward vertical plates are integrally formed on both the right and left sides of a horizontal plate, and threaded holes are provided at the same level at the front and rear ends of said right and left vertical plates;

a movable bracket fixed to the center of the bottom of the work table that covers said fixing bracket, wherein downward vertical plates are integrally formed on both the right and left sides of a horizontal plate, and insertion holes for lock screws are provided at the front end of said vertical plates, and elongated arcuate insertion holes for lock screws, the top of which is located at the same level as said insertion holes for the lock screws, are provided on the rear end of said vertical plates, and wherein said fixing bracket and said movable bracket are connected by screwing said lock screws, which are inserted through the insertion holes of said lock screws of said movable bracket, to the threaded holes of said fixing bracket.

* * * * *